United States Patent [19]

Steinau

[11] 4,182,350

[45] Jan. 8, 1980

[54] CIGARETTE FILTER

[75] Inventor: Peter Steinau, Mainz, Fed. Rep. of Germany

[73] Assignee: Hoechst Aktiengesellschaft, Frankfurt am Main, Fed. Rep. of Germany

[21] Appl. No.: 800,917

[22] Filed: May 26, 1977

[30] Foreign Application Priority Data

May 28, 1976 [DE] Fed. Rep. of Germany ..... 2623844

[51] Int. Cl.[2] ..... A24B 15/02; B01D 29/08

[52] U.S. Cl. ..... 131/269

[58] Field of Search ..... 131/10 R, 269, 268, 131/267, 266, ; 264/177 F, 176 F, 5, 13, 14, 121, 205; 162/157 R, 164 R, 166, 167, 158, 169; 260/29.6 XA

[56] References Cited

U.S. PATENT DOCUMENTS

| | | | |
|---|---|---|---|
| 3,451,887 | 6/1969 | Touey et al. | 131/269 |
| 3,770,856 | 11/1973 | Ueki et al. | 264/13 |
| 3,920,508 | 11/1975 | Yonimuri | 164/157 R |
| 3,920,509 | 11/1975 | Yonimuri | 162/157 R |

FOREIGN PATENT DOCUMENTS

| | | | |
|---|---|---|---|
| 635110 | 1/1962 | Canada | 131/269 |
| 915783 | 1/1963 | United Kingdom | 131/269 |

OTHER PUBLICATIONS

*The Condensed Chemical Dictionary,* Reinhold Publ. Co., N.Y., U.S.A., publication date 1962, p. 917.

*Primary Examiner*—Vincent Millin

*Attorney, Agent, or Firm*—Curtis, Morris & Safford

[57] ABSTRACT

Cigarette filters made of a fibrous adsorption agent, wherein the adsorption agent contains weakly hydrophilic polyolefin fibers made by a flash evaporation process, have excellent adsorption properties for tar and nicotine.

18 Claims, No Drawings

CIGARETTE FILTER

Cellulose acetate fibers are used almost exclusively at present as the filter material in cigarette filters (compare German Pat. No. 1 432 637). Furthermore, cigarette filters made of fibrillated polyolefin fiber material are also known, but, in order to obtain an adequate filtering action, this material must be reacted with active charcoal (compare British Pat. No. 1 220 678). Finally, a porous tobacco filter has also been described which is manufactured by sintering a cross-linked polyethylene in a mould (compare Japanese Patent Application No. 70 32 920).

It has now been discovered that polyolefin fibers manufactured in a specific manner have excellent adsorption properties for tar and nicotine and for this reason are especially well suited for the manufacture of cigarette filters.

The subject matter of the invention is thus a cigarette filter made of a fibrous adsorption agent, wherein the adsorption agent contains weakly hydrophilic polyolefin fibers which have been manufactured by flash evaporation of a pressurized, superheated emulsion consisting of (a) a solution of a polyolefin in a low-boiling solvent, and (b) an equeous solution of 0.05 to 0.7% by weight, relative to the polyolefin, of a hydrophilizing agent, through a nozzle into a zone of low pressure.

The polyolefin fibers to be used according to the invention are manufactured by a flash evaporation process in which a pressurized, superheated emulsion of (a) a solution of a polyolefin in a low-boiling solvent, and (b) an aqueous solution of a hydrophilizing agent is injected through a nozzle into a zone of low pressure, and wherein the hydrophilizing agent is used in a quantity of less than 0.7% by weight, relative to the polyolefin.

Above all, polyethylene having a reduced specific viscosity of from 0.3 to 30 dl/g, preferably from 0.7 to 10 dl/g, (determined according to H. Weslau Kunststoffe 49 (1959) 230) and a density of from 0.93 to 0.97 g/cm$^3$, or polypropylene are suitable polyolefins. These polyolefins may contain small amounts of comonomers having from 3 to 6 carbon atoms.

In principle, all known types of emulsifier are suitable as hydrophilizing agents, but preferably polymeric hydrophilizing agents having amine groups, amide groups, carboxyl groups and/or hydroxyl groups are used. Very good results are obtained in particular with polyvinyl alcohol having a viscosity in solution (measured in a 4% solution at 20° C. in water) of from 4 to 70 cP, and a saponification degree of from 80 to 99.5%. The hydrophilizing agent, which is preferably used in a quantity of from 0.05 to 0.7, preferably from 0.1 to 0.5% by weight, relative to the polyolefin, is sufficient in the specified quantity to render the polyolefin fibers dispersible in water, without, however, the adsorption properties being adversely influenced.

The solvent for the polyolefin must have a sufficiently low boiling point so that adequate superheating and flash evaporation are possible, but it must also have, in addition, a sufficiently high critical temperature. Consequently, hydrocarbons having 5 to 7 carbon atoms, preferably cyclic or acyclic saturated hydrocarbons having 5 to 6 carbon atoms, are suitable for the process according to the invention. In addition, chlorinated hydrocarbons having one or two carbon atoms, preferably methylene chloride, are also very suitable.

The temperature of the emulsion may vary within a wide range of from 110° to 200° C., but the preferred temperature range is from 120° to 160° C. The emulsion is under the inherent pressure of the water-solvent mixture, which pressure may be increased with an inert gas and/or by a pump.

The emulsion consisting of a solution of the polyolefin and a solution of the hydrophilizing agent should be as homogeneous as possible.

This is possible both when operating discontinuously and continuously, if the emulsion is manufactured in commercial emulsifying apparatuses having good material circulation and adequate shearing action. The advantages of the process according to the invention are demonstrated both in water-in-oil emulsions and in oil-in-water emulsions.

For the flash evaporation, the emulsion passes through a nozzle, the most important function of which is to maintain a difference in pressure between the emulsion and the flash evaporator. The pressure in the flash evaporator is so selected that the solvent for the polymer evaporates by more than 90%. A portion of the water also naturally evaporates during this. The pressure should, in general, be from 10 to 1,500 torr, but preferably from 50 to 800 torr. The weakly hydrophilic polyolefin fibers obtained may be comminuted and dehydrated in commercial apparatuses.

These fibers are sufficiently effective, without the addition of further adsorption agents, to remove the tar and nicotine to a large extent from the tobacco smoke. The adsorption effect occasioned by the extremely large surface area of the fibers is so intensive that smaller filters may be used, or the cigarette filters of customary length need be manufactured only partially from polyolefin fibers. Otherwise, such an extensive de-contamination of the tobacco smoke would occur that the taste might be impaired. The weakly hydrophilic polyolefin fibers mentioned can therefore be used in cigarette filters mixed with cellulose acetate. In general, the proportion of the polyolefin fibers is from 10 to 80% by weight, preferably from 30 to 60% by weight, of the fiber material contained in the cigarette filter. Cigarette filters of this kind may be manufactured using processes and machines customary in the cigarette industry. Glycerol triacetate may also be used to advantage here as plasticizer and adhesive.

Cigarette filters made of cellulose acetate are in most cases manufactured from an endless rope of texturized fibers, by spreading out this fiber rope into a net-like structure after it has entered the machine and then spraying it with glycerol triacetate. The sprayed, net-like structure is then reshaped into a round rope and a web of cigarette paper moving along with it is wrapped around it and the paper overlapped and sealed with a fusible adhesive. This endless filter is then cut up into filter sticks of a specific length, and stored. The polyolefin fibers may be incorporated, for example, immediately before the spraying step, by placing a fleece of the fibers on the net-like structure of the acetate fibers using an air delivery process. In this case, operation can be carried out with a clearly reduced weight per meter of the acetate fiber rope.

It is in addition possible, to process the fibers to be used according to the invention to form endless filter structures on a machine which operates according to the principle of cigarette manufacture. In this case, instead of the tangle of tobacco fibers, the polyolefin fibers are fed to the machine and shaped in the usual manner in longitudinal grooves into a round rope, which is wrapped around by a paper web that passes along with it, the paper being overlapped in the shape of a tube and sealed with fusible adhesive.

A further possibility for the manufacture of cigarette filters according to the invention comprises manufacturing a longitudinally crêped paper of high-adsorptive capacity from the polyolefin fibers and cellulose, which paper can be used with or without additional charcoal filter on cigarette filter machines instead of the now customary cellulose crêpe papers. In this case, the quantity of polyolefin fibers may be varied between 10 to 80% by weight, relative to the weight of the crêpe paper.

The following examples illlustrate the invention.

EXAMPLE 1

An autoclave of 250 liters capacity, provided with a stirrer and outlet valve which is connected by way of a pipe to a nozzle leading into a flash evaporating vessel, is charged with 10 kg of polyethylene (density 0.95 g/cm$^3$, MFI 190/5 ,22g (10 min),120 liters of water, 20 g of polyvinyl alcohol (viscosity 4.6 to 6 cP in a 4% solution in water at 20° C., saponification degree 98.5 to 100 mole %) and 120 liters of hexane. The autoclave is then sealed and the contents of the autoclave are heated, while stirring, to 150° C. and maintained at this temperature for about 2½ hours. During this time a pressure of 12.3 kg/cm$^2$ is reached. After the polyethylene has dispersed and the contents of the autoclave have changed into an emulsion, the outlet valve is opened and the emulsion is discharged into the flash evaporating vessel in the same proportion as a vacuum pump joined to this vessel can suction off the vapours being released and maintain a pressure of about 200 mm Hg. The resulting fibers are made into a paste with water, passed seven times through a disc refiner and then water is removed from them by centrifuging. The fibers were fluffed up in a current of air and dried, and had a classified fiber length according to TAPPI standard T 233 Su 64 of 1.55 mm.

For the manufacture of the test filter, the polyethylene fibers were introduced between two 3 mm long sheets of customary acetate filter in a cylindrical chamber 8 mm in diameter and 20 mm in length.

Test of the filter efficiency

A cigarette filter according to the invention 20 mm in length, made according to the chamber principle from 3 mm cellulose acetate fibers (=20 mg)/14 mm polyethylene fibers according to the invention (=19 mg)/3mm cellulose acetate fibers (=20 mg) having a diameter of 8 mm, was compared with a conventional cellulose acetate filter. The following values were measured:

| | Filter according to the invention 20 mm long, 59 mg | Known filter 19 mm long, 150 mg |
|---|---|---|
| Draw resistance mm water column, total | 119 | 124 |
| Length of stub, mm | 28 | 27 |
| Number of draws | 9.7 | 10.0 |
| Moist tar, mg | 14.0 | 14.9 |
| Dry tar, mg | 12.1 | 13.3 |

-continued

| | Filter according to the invention 20 mm long, 59 mg | Known filter 19 mm long, 150 mg |
|---|---|---|
| Smoke nicotine, mg | 0.51 | 0.63 |
| Filter nicotine, mg | 0.60 | 0.46 |
| Filter efficiency, direct with respect to nicotine % | 54.0 | 42.2 |

Thus, with the filter according to the invention, with less than half the quantity of filter material, an efficiency is achieved which is approximately the same as or better than that of the known filter. Taking into consideration the efficiency of the proportion of cellulose acetate in the filter according to the invention, it emerges that 19 mg of polyethylene fibers has a filter efficiency equally as good as 110 mg of cellulose acetate.

What is claimed is:

1. A cigarette filter which has been produced by flash evaporation of a pressurized, superheated emulsion of (a) a solution of a polyolefin in a low-boiling solvent, and (b) an aqueous solution of from 0.05 to 0.7% by weight, relative to the polyolefin, of a hydrophilizing agent, through a nozzle into a zone of low pressure and forming the product of said evaporation into a fibrous filter mass.

2. A cigarette filter as defined in claim 1, wherein the polyolefin is polyethylene having a reduced specific viscosity of from 0.3 to 30 dl/g and a density of from 0.93 to 0.97 g/cm$^3$.

3. A cigarette filter as defined in claim 1, wherein the hydrophilizing agent is a polymeric hydrophilizing agent having an amine group, amide group, carboxyl group, hydroxyl group or a mixture thereof.

4. A cigarette filter as defined in claim 1, wherein the hydrophilizing agent is present in an amount of from 0.1 to 0.5% by weight.

5. A cigarette filter as defined in claim 1, wherein the solvent is a hydrocarbon of from 5 to 7 carbon atoms or a chlorinated hydrocarbon of from 1 to 2 carbon atoms.

6. A cigarette filter as defined in claim 1, wherein the emulsion is at a temperature of from 110° to 200° C.

7. A cigarette filter as defined in claim 1, wherein the pressure in the flash evaporator is such that more than 90% of the solvent for the polymer evaporates.

8. A cigarette filter as defined in claim 1, wherein the polyolefin contains a small amount of a comonomer of from 3 to 6 carbon atoms.

9. A cigarette filter as defined in claim 1, wherein said evaporation product is combined with cellulose acetate during said forming step.

10. A method for reducing the content of tar and nicotine in cigarette smoke, which comprises passing the smoke through a cigarette filter containing weakly hydrophilic polyolefin fibers which have been manufactured by a flash evaporation of a pressurized, superheated emulsion of (a) a solution of polyolefin in a low boiling solvent, and (b) an aqueous solution of from 0.05 to 0.7% by weight, relative to the polyolefin, of a hydrophilizing agent, through a nozzle into a zone of lower pressure.

11. A method as defined in claim 10, wherein the polyolefin is polyethylene having a reduced specific viscosity of from 0.3 to 30 dl/g and a density of from 0.93 to 0.97 g/cm$^3$.

12. A method as defined in claim 10, wherein the hydrophilizing agent is a polymeric hydrophilizing agent having an amine group, amide group, carboxyl group, hydroxyl group, or a mixture thereof.

13. A method as defined in claim 10, wherein the hydrophilizing agent is present in an amount of from 0.1 to /0.5% by weight.

14. A method as defined in claim 10, wherein the solvent is a hydrocarbon of from 5 to 7 carbon atoms or a chlorinated hydrocarbon of from 1 to 2 carbon atoms.

15. A method as defined in claim 10, wherein the emulsion is at a temperature of from 110° to 200° C.

16. A method as defined in claim 10, wherein the pressure in the flash evaporator is such that more than 90% of the solvent for the polymer evaporates.

17. A method as defined in claim 10, wherein the polyolefin contains a small amount of a comonomer of from 3 to 6 carbon atoms.

18. A method as defined in claim 10, wherein the polyolefin fibers are combined with cellulose acetate.

* * * * *